US010229626B2

(12) United States Patent
Kim et al.

(10) Patent No.: US 10,229,626 B2
(45) Date of Patent: Mar. 12, 2019

(54) TIMING CONTROLLER GENERATING PSEUDO CONTROL DATA INCLUDED IN CONTROL PACKET AND N-BIT IMAGE DATA INCLUDED IN RGB PACKET

(71) Applicant: LG DISPLAY CO., LTD., Seoul (KR)

(72) Inventors: ChangKun Kim, Suwon-si (KR); JoungTae Kim, Goyang-si (KR); TaeYoung Jung, Daegu (KR)

(73) Assignee: LG DISPLAY CO., LTD., Seoul (KR)

( * ) Notice: Subject to any disclaimer, the term of this patent is extended or adjusted under 35 U.S.C. 154(b) by 170 days.

(21) Appl. No.: 15/167,069

(22) Filed: May 27, 2016

(65) Prior Publication Data

US 2016/0351099 A1 Dec. 1, 2016

(30) Foreign Application Priority Data

May 29, 2015 (KR) ..... 10-2015-0075741

(51) Int. Cl.
*G09G 3/20* (2006.01)

(52) U.S. Cl.
CPC ..... *G09G 3/2044* (2013.01); *G09G 3/2037* (2013.01); *G09G 2310/08* (2013.01)

(58) Field of Classification Search
CPC ..... G09G 3/2037; G09G 2310/08; G09G 3/20
See application file for complete search history.

(56) References Cited

U.S. PATENT DOCUMENTS 6,970,121 B1 * 11/2005 Sun ..... G09G 3/3688 341/144
8,847,997 B2 * 9/2014 Seo ..... G09G 3/3225 345/690
8,848,005 B2 * 9/2014 Chen ..... G09G 3/2007 345/690
2002/0196218 A1 * 12/2002 Ham ..... G09G 3/3611 345/87
2005/0062764 A1 3/2005 Park et al.
2007/0030192 A1 2/2007 Son et al.
2010/0134533 A1 * 6/2010 Moon ..... G09G 3/3611 345/690
2010/0188393 A1 * 7/2010 Seki ..... G09G 3/2025 345/213

(Continued)

FOREIGN PATENT DOCUMENTS

CN 1265344 C 7/2006
CN 1940645 A 4/2007

(Continued)

*Primary Examiner* — Kwang-Su Yang
(74) *Attorney, Agent, or Firm* — Birch, Stewart, Kolasch & Birch, LLP

(57) ABSTRACT

A timing controller including a memory unit configured to store image data with respect to p*q sub-pixels defined using p numbers of data lines and q numbers of gate lines, a reception unit configured to receive, from a host, (n+m)-bit image data with respect to each of two or more of the sub-pixels, a controller configured to generate pseudo control data corresponding to m-bit image data of the two or more of the sub-pixels, and an output unit configured to output n-bit image data with respect to each of the sub-pixels to a digital unit of a data driving unit, and output the pseudo control data to an analog unit of the data driving unit.

6 Claims, 12 Drawing Sheets

(56) References Cited

U.S. PATENT DOCUMENTS

| | | | | |
|---|---|---|---|---|
| 2010/0231426 | A1* | 9/2010 | Van Der Vleuten ... | H04N 19/46<br>341/107 |
| 2014/0333816 | A1* | 11/2014 | Uchida ..... | H04N 5/37455<br>348/308 |

FOREIGN PATENT DOCUMENTS

| | | | |
|---|---|---|---|
| CN | 101751845 | A | 6/2010 |
| JP | 2009-157169 | A | 7/2009 |

* cited by examiner

610

| 10BIT GRAY SCALE | UPPER 8BIT(12B) | LOWER 2BIT |
|---|---|---|
| 512 | 1000 0000 | 00 |
| 513 | 1000 0000 | 01 |
| 514 | 1000 0000 | 10 |
| 515 | 1000 0000 | 11 |

620

TIMING CONTROLLER GENERATING PSEUDO CONTROL DATA INCLUDED IN CONTROL PACKET AND N-BIT IMAGE DATA INCLUDED IN RGB PACKET

CROSS REFERENCE TO A RELATED APPLICATION

This application claims priority from Korean Patent Application No. 10-2015-0075741, filed on May 29, 2015, which is hereby incorporated by reference for all purposes as if fully set forth herein.

BACKGROUND OF THE INVENTION

1. Field of the Invention

The present invention relates to a timing controller and a display device.

2. Description of the Related Art

Display devices are increasingly required in various forms, and in recent years, various display devices such as liquid crystal displays (LCDs), plasma display panels (PDPs), and organic light emitting display devices (OLEDs) have been utilized. Such a display device includes a display panel in which data lines and gate lines are formed, and sub-pixels defined by a point where the data lines and the gate lines intersect each other; a data driving unit that supplies a data voltage to the data lines; a gate driving unit that supplies a scan signal to the gate lines; and a timing controller that controls the data driving unit and the gate driving unit.

In order to control the data driving unit and the gate driving unit, the timing controller generates an internal data enable signal based on a data enable signal input from the outside, and generates and outputs control signals that control the data driving unit and the gate driving unit, based on the generated internal data enable signal. Further, a data signal provides information of a color to be expressed by pixel. In particular, RGB image data is provided for each RGB color from the timing controller to a data driver, where as the number of bits expressing RGB image data increases, the quality of an image improves. However, the data to be processed increases.

SUMMARY OF THE INVENTION

Accordingly, one object of the present invention is to address the above-noted and other problems with the related art.

Another object of the present invention is to provide a timing controller and a display device for implementing a high resolution image.

Still another object of the present invention is to provide a timing controller and a display device, which divide and disperse image data controlling sub-pixels into a data packet and a control packet so as to provide the same to a data driving unit.

Another object of the present invention is to provide a timing controller and a display device, which configure image data controlling multiple sub-pixels as a piece of pseudo control data so that a high resolution image can be implemented.

To achieve these and other advantages and in accordance with the purpose of the present invention, as embodied and broadly described herein, the present invention provides in one aspect a timing controller including a memory unit configured to store image data with respect to p*q sub-pixels defined using p numbers of data lines and q numbers of gate lines; a reception unit configured to receive, from a host, (n+m)-bit image data with respect to each of two or more of the sub-pixels; a controller configured to generate pseudo control data corresponding to m-bit image data of the two or more of the sub-pixels; and an output unit configured to output n-bit image data with respect to each of the sub-pixels to a digital unit of a data driving unit, and output the pseudo control data to an analog unit of the data driving unit.

In another aspect, the present invention provides a display device including a display panel including p*q sub-pixels defined using p numbers of data lines and q numbers of gate lines; a gate driving unit configured to apply a scan signal to the gate lines of the display panel; a data driving unit configured to apply a data voltage to sub-pixels connected to the gate lines to which the scan signal is applied by the gate driving unit; and a timing controller configured to receive a first image data from a host and provide, to the data driving unit, a second image data corresponding to the data voltage, and output, to the data driving unit, pseudo control data corresponding to m-bit image data of two or more sub-pixels and each piece of n-bit image data of the two or more of the sub-pixels, as the second image data.

Further scope of applicability of the present invention will become apparent from the detailed description given hereinafter. However, the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EMBODIMENTS

Figure 1:
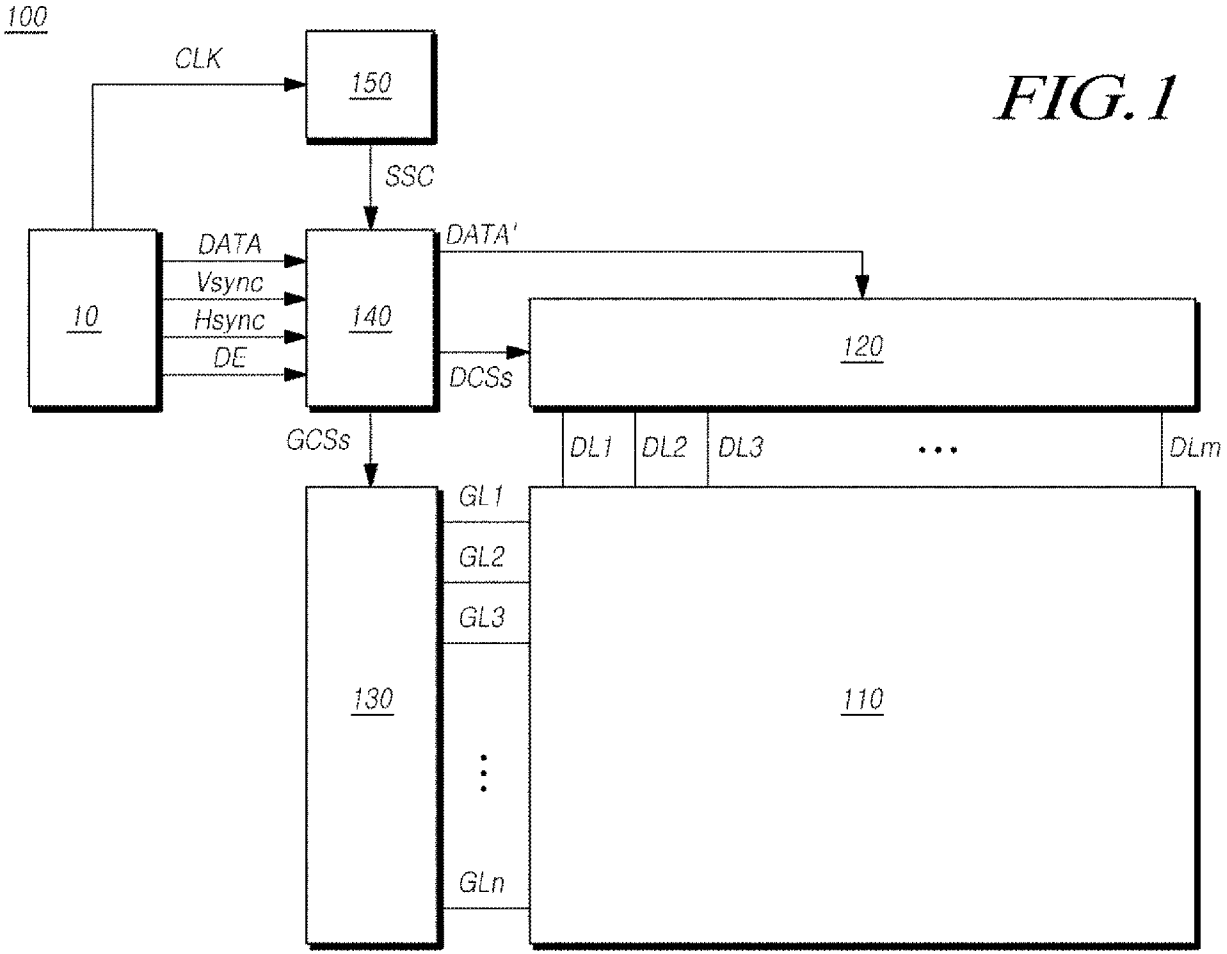
FIG. 1 is a system configuration diagram of a display device according to an embodiment of the present invention.

Hereinafter, some embodiments of the present invention will be described in detail with reference to the accompanying illustrative drawings. In designating elements of the drawings by reference numerals, the same elements will be designated by the same reference numerals although they are shown in different drawings. Further, in the following description of the present invention, a detailed description of known functions and configurations incorporated herein will be omitted when it may make the subject matter of the present invention rather unclear.

In addition, terms, such as first, second, A, B, (a), (b) or the like may be used herein when describing components of the present invention. Each of these terminologies is not used to define an essence, order or sequence of a corresponding component but used merely to distinguish the corresponding component from other component(s). In the case that it is described that a certain structural element "is connected to", "is coupled to", or "is in contact with" another structural element, it should be interpreted that another structural element may "be connected to", "be coupled to", or "be in contact with" the structural elements as well as that the certain structural element is directly connected to or is in direct contact with another structural element.

FIG. 1 is a system configuration diagram of a display device 100. Referring to FIG. 1, the display device 100 includes a display panel 110 in which m numbers of data lines (DL1, . . . , DLm, m: a natural number) and n numbers of gate lines (GL1, . . . , GLn, n: a natural number) intersect and are arranged, and sub-pixels are arranged in a matrix type manner; a data driving unit 120 that supplies data voltages to the m numbers of data lines (DL1, . . . , DLm) in order to drive the m numbers of data lines (DL1, . . . , DLm); a gate driving unit 130 that sequentially supplies scan signals to the n numbers of gate lines (GL1, . . . , GLn) in order to sequentially drive the n numbers of gate lines (GL1, . . . , GLn); and a timing controller 140 that controls the data driving unit 120 and the gate driving unit 130.

In the display panel 110, a sub-pixel is formed in each point at which a data line and one or more gate lines intersect. Further, the timing controller 140 starts performing a scan according to an implementation timing in each frame, converts image data input from an interface to meet a data signal form used by the data driving unit 120 so as to output the converted image data (Data'), and controls data driving at a proper time according to the scan. The timing controller 140 also outputs various types of control signals in order to control the data driving unit 120 and the gate driving unit 130.

In addition, the gate driving unit 130 sequentially supplies scan signals of on-voltages or off-voltages to n numbers of gate lines (GL1, . . . , GLn), according to a control of the timing controller 140, and sequentially drives n numbers of gate lines (GL1, . . . , GLn). The gate driving unit 130 may also be positioned on only one side of the display panel 110 as illustrated in FIG. 1 or may be divided into two and positioned on both sides of the display panel 110, depending on a driving manner.

In addition, the gate driving unit 130 may include multiple gate driver integrated circuits. In more detail, the multiple gate driver integrated circuits can be connected to a bonding pad of the display panel 110 through a tape automated bonding (TAB) method or a chip on glass (COG) method, or implemented in a gate in panel (GIP) type and directly formed in the display panel 110. The multiple gate driver integrated circuits may also be integrated and formed in the display panel 110. Each gate driver integrated circuit described above may include a shift register, a level shifter, and so on.

Further, the data driving unit 120 stores, in a memory, image data (Data) input by a host system 10 according to a control of the timing controller 140, and upon the opening of a particular gate line, converts corresponding image data (Data') into a data voltage (Vdata) in the analog form, and supplies the same to m numbers of data lines (DL1, . . . , DLm), so as to drive the m numbers of data lines (DL1, . . . , DLm).

The data driving unit 120 may include multiple source driver integrated circuits (source driver IC, also referred to as data driver integrated circuit (data driver IC)). The multiple source driver integrated circuits can be connected to a bonding pad of the display panel 110 through the tape automated bonding (TAB) method, the chip on class (COG) method, or directly formed in the display panel 110. The multiple source driver integrated circuits may also be integrated and formed in the display panel 110.

Each source driver integrated circuit described above may include a shift register, a latch, a digital analog converter (DAC), an output verter, and so on, and occasionally, may further include an analog digital converter (ADC) that generates and outputs sensing data by sensing an analog voltage value and converting the same into a digital value for sub-pixel compensation.

In addition, the host system 10 described above transmits, along with digital video data (Data) of an input image, various types of timing signals including a vertical synchronization signal (Vsync), a horizontal synchronization signal (Hsync), an input data enable (DE, hereinafter, referred to as "DE") signal, a clock signal (CLK), and so on, to the timing controller 140.

The timing controller 140 converts data (Data) input by the host system 10 to meet a data signal form used by the data driving unit 120 so as to output converted image data (Data'). In addition, the timing controller 140 receives, from the host system 10, an input of a timing signal such as a vertical synchronization signal (Vsync), a horizontal synchronization signal (Hsync), an input DE signal, and a clock signal, and generates various types of control signals so as to output the same to the data driving unit 120 and the gate driving unit 130, in order to control the data driving unit 120 and the gate driving unit 130.

For example, the timing controller 140 outputs gate control signals (GCSs) including a gate start pulse (GSP), a gate shift clock (GSC), a gate output enable (GOE) signal, etc., in order to control the gate driving unit 130. The gate start pulse (GSP) controls a movement start timing of gate driver integrated circuits constituting the gate driving 130. Further, the gate shift clock (GSC) that is a clock signal commonly input to the gate driver integrated circuits controls a shift timing of a scan signal (a gate pulse). The gate output enable signal (GOE) designates timing information of the gate driver integrated circuits.

In addition, the timing controller 140 outputs data control signals (DCSs) including a source start pulse (SSP), a source sampling clock (SSC), a source output enable (SOE) signal, etc., in order to control the data driving unit 120. The source start pulse (SSP) controls a data sampling start timing of source driver integrated circuits constituting the data driving unit 120. Further, the source sampling clock (SSC) is a clock signal controlling a sampling timing of data in each of the source driver integrated circuits.

The source output enable signal (SOE) controls an output timing of the data driving unit 120. A polarity control signal (POL) can also be further included in the data control signals (DCSs) in order to control the polarity of a data voltage of the data driving unit 120. If data (Data') input to the data driving unit 120 is transmitted according to a mini low voltage differential signaling (LVDS) interface standard, the source start pulse (SSP) and the source sampling clock (SSC) may be omitted.

The display device 100, which is schematically illustrated in FIG. 1, may be one of a liquid crystal display (LCD) device, a plasma display device, an organic light emitting display (OLED) device, and so on. Circuit devices, such as a transistor, a capacitor, etc. are formed in each sub-pixel formed in the display panel 110 described above. For example, when the display panel 110 is an organic light emitting display panel, circuit devices, such as an organic light emitting diode, two or more transistors, one or more capacitors, etc. may be formed on each pixel.

In addition, an input DE signal is input to the timing controller 140 where a high section of the input DE signal is synchronized with first line data of an input image and indicates an input timing of the first line data. A first cycle of the input DE signal is a horizontal term (HT). Further, image data can be divided by a particular color. For example, the image data can be defined as a size of 10-bit in order to express each of RGB. In addition, the timing controller can provide such RGB image data through a form of packet data to a data driver.

An embodiment of a packet output by the timing controller may have an embedded point to point interface (EPI) packet. In addition, an embodiment of packet data includes advanced voltage differential signaling (AVDS), advanced current differential signaling (ACDS), reduced swing differential signaling (RSDS), transistor-transistor logic (TTL), enhanced reduced swing differential signaling (eRVDS), and so on.

Packet data output by the timing controller 140 to the data driving unit 120, for example, a data driver IC, can be divided into a control packet and a data packet, and the packet data is transmitted according to a predetermined timing. Further, the control packet controls a number of selection matters of the data driver IC, and the data packet includes color information to be expressed in actual pixels. The control packet and the data packet are also divided according to a particular rule, which may be the overhead of a corresponding interface transmission, and it is thus preferably to reduce the size of the packets.

Figure 2:
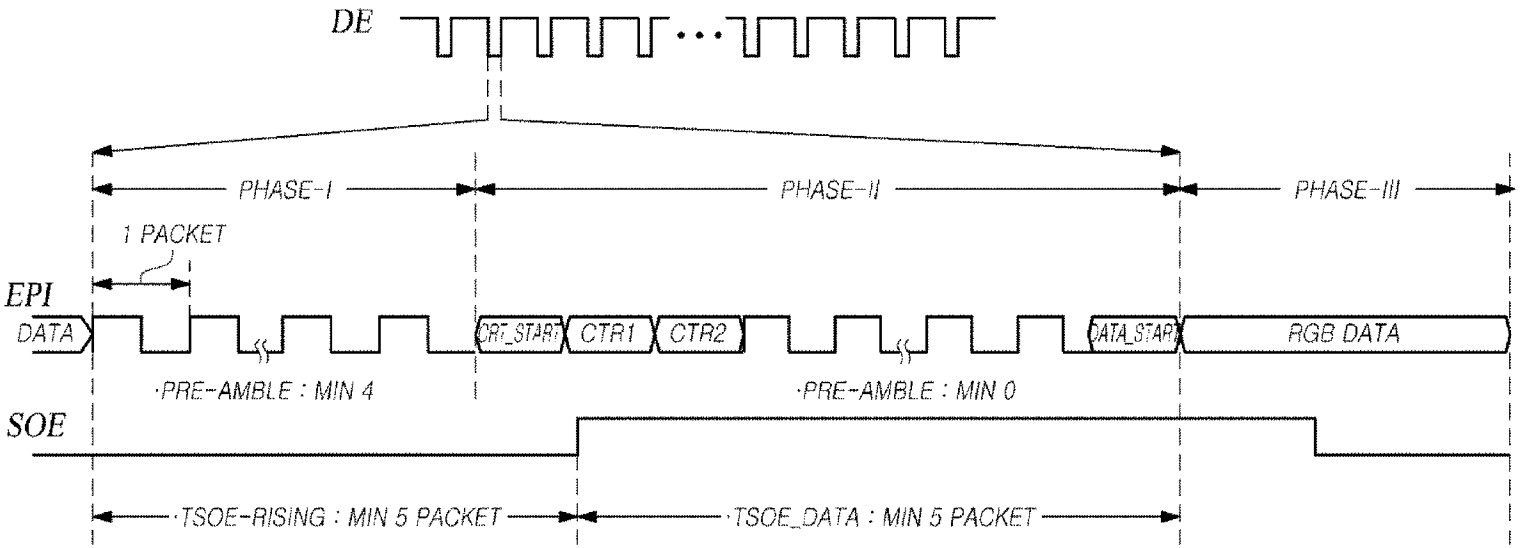
FIG. 2 is a diagram illustrating a structure of a packet according to an embodiment of the present invention.

Next, FIG. 2 is a diagram illustrating a structure of a packet according to an embodiment of the present invention. An expansion of a low section of a data enable (DE) signal is the same as phase-I/II in reference numeral. Phase-I includes one or more preamble packets, and phase-II includes a control start (CTR_Start), multiple control packets (CTRL1 and CTRL2), and a preamble data and data start (Data_Start) packet. In addition, phase-III includes RGB image data (RGB Data). Further, the source output enable signal is converted to the low up to the control start, but converted to the high thereafter.

In addition, the RGB image data can be divided into a scheme in which all of the RGB is included within a packet, and a scheme in which sub-pixel information of one or two of the RGB is included within a packet. Accordingly, the amount of information indicating each R, G, and B can vary depending on the amount of information indicating one sub-pixel, that is, a case of high resolution and a case of the other, and the size of information that can be included within a packet may be different.

Figure 3:
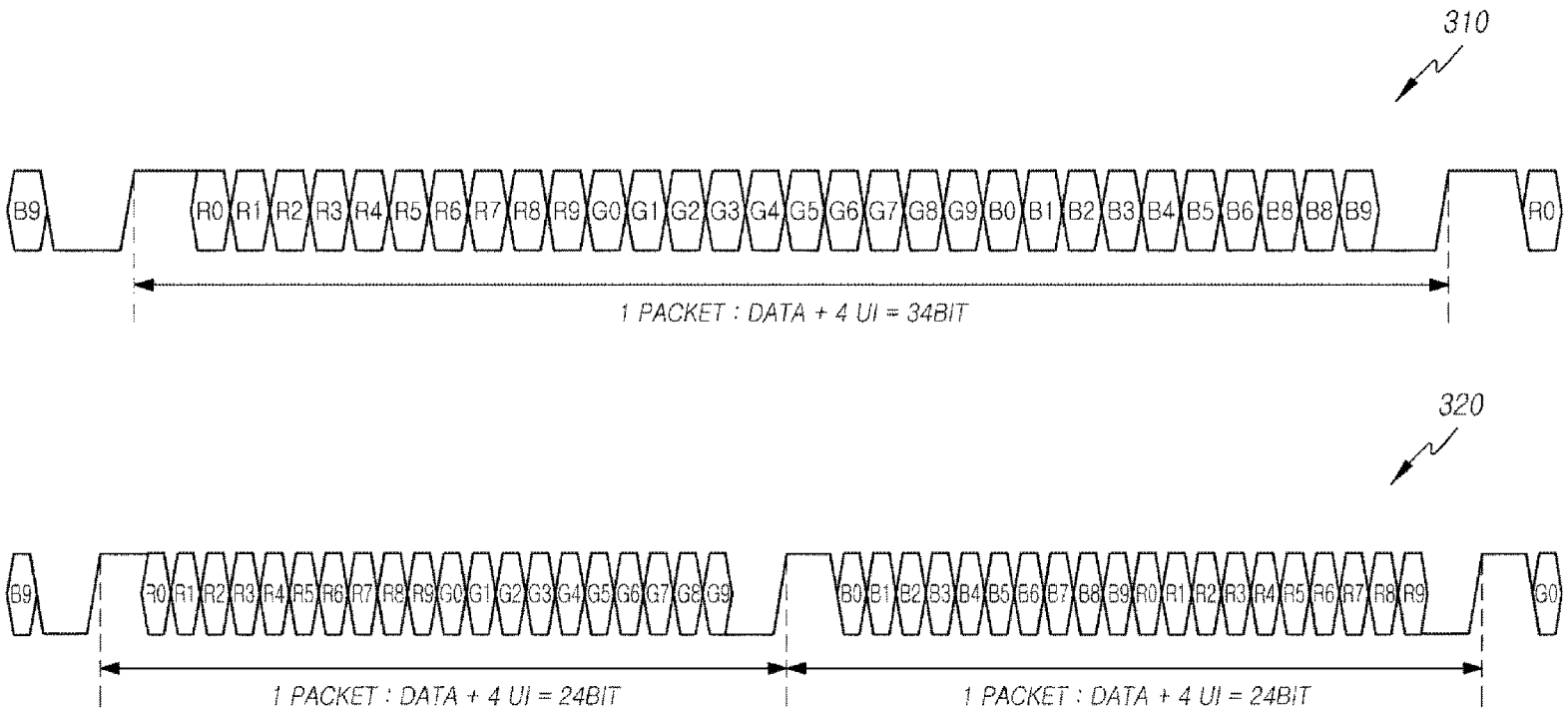
FIG. 3 is a diagram illustrating a configuration of RGB image data constituting a packet.

Next, FIG. 3 is a diagram illustrating a configuration of RGB image data constituting a packet. In reference numeral 310, one packet includes a total of 34 bits including 10 bits for each of RGB image data, which is 30 bits, and four bits for four unit intervals (UIs). In addition, one pixel (three sub-pixels) data can be transmitted to one packet, the lock fail margin is decreased, and a source shift clock performance value is lowered.

In reference numeral 320, one packet includes a total of 24 bits including 20 bits of RGB image data and four bits for four UIs. Here, one piece of pixel information can be divided into two packets and an overhead is increased due to the data division. When a protocol is changed for implementing high resolution, only a data packet can be modified to correspond thereto.

Hereinafter, in an embodiment of the present invention, a part of a data packet is included in a control packet, thereby transmitting the same to a data driver IC. Further, the data included in the control packet is referred to as pseudo control data. The control packet can be newly transmitted to one horizontal time (1 H time), and the timing controller can analyze a pattern stored in a frame memory, and select and transmit proper pseudo control data to the data driver IC.

Figure 4:
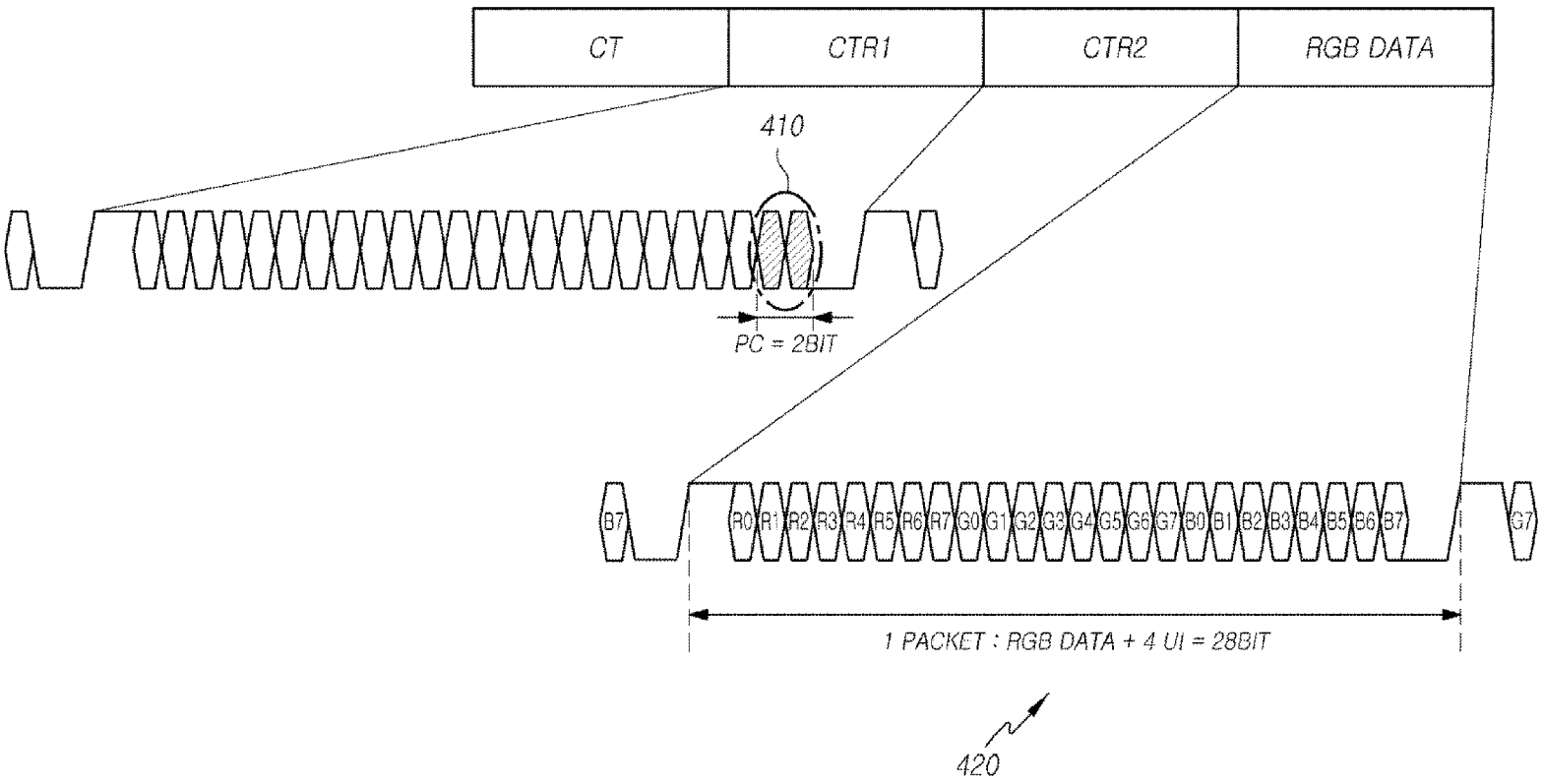
FIG. 4 is a diagram illustrating a configuration in which pseudo control data is two bits according to an embodiment of the present invention.

Next, FIG. 4 is a diagram illustrating a configuration in which pseudo control data is two bits according to an embodiment of the present invention. The pseudo control (PC) data is included in the control packet (CTRL1), as shown in reference numeral 410. In addition, RGB image data (RGB Data) has eight bits for each RGB, as shown in reference numeral 420. Here, since two bits of PC data are combined to each sub-pixel of RGB image data, the actual RGB data is transmitted by eight bits per sub-pixel, but output data is 10 bits.

The timing controller 140 can select which value to configure for the PC data. In addition, a solid pattern scheme can be applied as a first embodiment, and a complex pattern scheme can be applied as a second embodiment. The solid pattern scheme uses the least significant bit (LSB) data of image data, and the complex pattern scheme alternately outputs the LSB data.

Through this configuration, it is possible to improve a bandwidth between the timing controller 140 and the data driving unit 120 and transmit high resolution data without an increase of a transmission overhead. That is, high resolution data implementation is possible without a side effect due to the improvement of a bandwidth.

In addition, bits allocated to pseudo control data by the timing controller 140 can vary according to the number of reserved bits of the control packet. Also, the sizes of bits to be allocated to the pseudo control data can be differently applied according to the size of data that can be processed in a latch of the data driver IC. For example, when RGB data to be output from an actual panel is X bits and the size of data that can be processed in a latch of the data driver IC is Y bits ($Y<X$), pseudo control data can be $(X-Y)$ bits.

Figure 5:
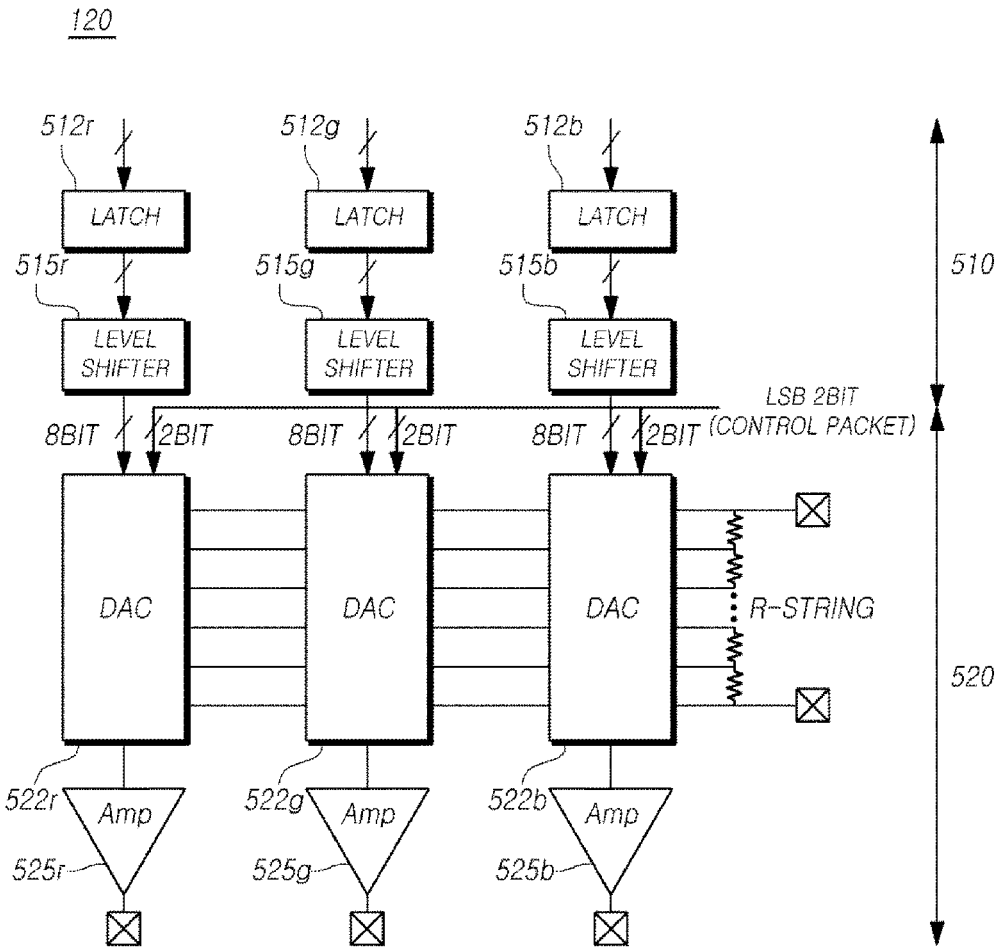
FIG. 5 is a block diagram of a data driver IC according to an embodiment of the present invention.

Next, FIG. 5 is a block diagram of a data driver IC according to an embodiment of the present invention. A configuration of processing image data input to a pixel constituting RGB sub-pixels will now be described. In a pixel, some part (upper eight bits) is input to a digital unit 510 by each of RGB, and the lower two-bit parts of RGB are input together to an analog unit 520.

In the digital unit 510 of the data driver IC, latches 512*r*, 512*g*, and 512*b* and level shifters 515*r*, 515*g*, and 515*b* process eight-bit image data for each R, G, and B. In addition, two-bit pseudo control data included in the control packet, as described in FIG. 4, is applied to the LSB data of the RGB image data. Consequently, 10 bits are applied to each digital analog converters (DAC) 522*r*, 522*g*, and 522*b*, and transmitted to each amplifiers (AMPs) 525*r*, 525*g*, and 525*b*, so as to display RGB on the display panel 110 of FIG. 1.

The digital unit 510 can provide eight-bit information on each RGB, and the analog unit 520 can output 10-bit image data for each RGB, in which two bits are added, as the LSB, to the eight-bit information of the digital unit 510, using pseudo control data in the control packet transmitted by the timing controller 140. As a result, two or more bits are added to the resolution of image data, relative to eight bits processed by the digital unit 510, and high resolution data can be thus output on the display panel.

The configuration in FIG. 5 is advantageous because high resolution image data is output without a circuit change of the digital unit 510. In addition, for selecting two bits by the timing controller 140, two bits having four types of values (00, 01, 10, and 11) may be selected in various manners. For example, in an interface having an embedded clock, some data may be included in the control packet and transmitted so as to implement high resolution without adding a separate bandwidth.

Hereinafter, a timing controller to be described stores image data with respect to p*q sub-pixels defined using p numbers of data lines and q numbers of gate lines, and transmits the stored image data, i.e., the image data with respect to p numbers of data lines for a gate line, to a data driving unit. Here, each data line controls a sub-pixel, where each sub-pixel indicates a color like R, G, and B. Image data required to be displayed in each sub-pixel is (n+m) bits, but n bits (eight bits) are applied to the digital unit 510 and m bits (two bits) are applied to the analog unit 520 so that a digital-analog conversion unit combines (n+m) bits, as described in FIG. 5.

When RGB constitutes one pixel and m bits (e.g., LSB two bits) of image data constituting each sub-pixel are equally set for each RGB, the application can vary depending on where each sub-pixel of RGB has the same LSB two bits and where each sub-pixel of RGB has a different bit. For example, when 10-bit data is allocated to each RGB and m bits of the 10-bit data is LSB two bits, pseudo control data "01" can be set as the same two-bit value when the least significant of RGB image data are the same, like the following equation (1).

$$\text{Data}(R)=xxxxxxxx01$$

$$\text{Data}(G)=xxxxxxxx01$$

$$\text{Data}(B)=xxxxxxxx01 \qquad \text{Mathematical Equation 1}$$

In this instance, an embodiment is directed to when RGB have the upper n bits having the same value, e.g., white, gray, or black, but is not limited thereto. The present invention can also be applied to when each of the upper n bits of RGB is the same upon expressing a particular color. Also, m bits do not necessarily mean a most significant or a least significant bit but mean the bit value of a predetermined area. For example, the present invention can be applied to m bits of a middle section. However, since information, i.e. LSB, gives the least effect on overall color in consideration of characteristics of a RGB combined gray scale, the quality of an image can be maintained when a same LSB value is provided as pseudo control data.

Figure 6:
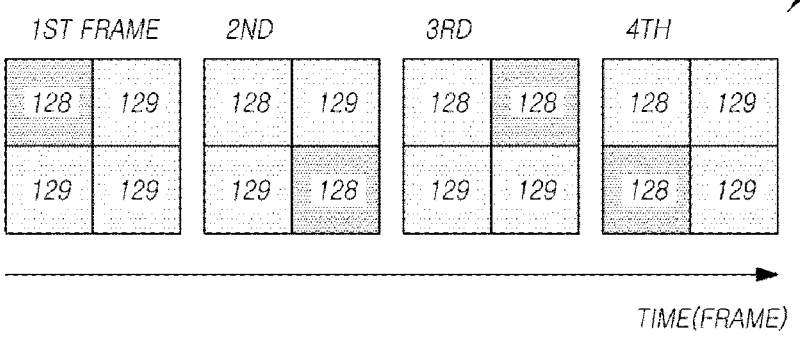
FIG. 6 is a diagram illustrating the result of dithering on 10-bit image data.

Next, FIG. 6 is a diagram illustrating the result of dithering on 10-bit image data. 610 is a diagram illustrating upper bits and lower bits corresponding to each of the gray scales for dithering and 620 is a diagram illustrating expression of the gray scales for dithering in each of the frames. When the gray scale of 10 bits is each of 512, 513, 514, and 515, and is divided into upper eight bits and lower two bits, the upper eight bits, which is 128*4, all have the same value of "1000 0000". In addition, the values of the lower two bits are only "00", "01", "10", and "11". Here, in a first frame (1st Frame), the gray scale value of the upper left sub-pixels is set to 128, and the gray scale value of the sub-pixels except therefor is set to 129. The gray scales of the upper left and bottom right sub-pixels are 128 in the following frame (2nd Frame), the gray scales of the upper left and upper right sub-pixels are 128 in a third frame (3rd frame), and the gray scales of the upper left and bottom left sub-pixels are 128 in a fourth frame (4th frame). According to an embodiment of the present invention, four sub-pixels can be combined to express gray scale.

Figure 7:
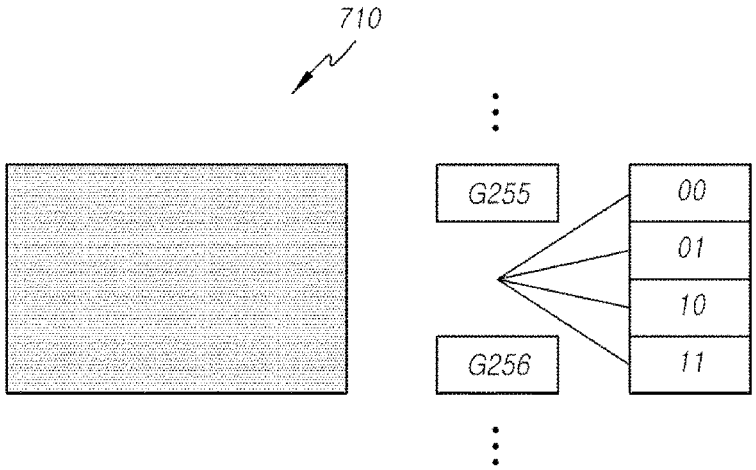
FIG. 7 is a diagram illustrating actual lower two bits of image data as pseudo control data according to an embodiment of the present invention.

Next, FIG. 7 is a diagram illustrating the actual lower two bits of image data as pseudo control data according to an embodiment of the present invention. When the lower two bits are included in the pseudo control data and the upper eight bits express gray color on the front side of a panel 710, the gray levels can be divided into four levels. That is, "00", "01", "10", and "11", which indicate the lower two bits, can be located between a gray level G255 and G256, so as to express gray levels in more detail.

In conclusion, like RGB, the particular m bits of RGB, e.g., RGB sub-pixels displaying gray, can set the lower m bits to be the same. When the upper eight bits are information indicating color, and the lower two bits are information indicating luminance, the lower two bits can be the same. That is, the timing controller or the control unit constituting the timing controller generates m-bit image data as pseudo control data when m-bit image data of two or more sub-pixels are the same.

In this instance, since the data driving unit receives pseudo control data m bits and each of sub-pixels n bits, a data compression ratio increases in proportion to the number of sub-pixels collected relating to the pseudo control data and m bits. Further, the reduced size of data is (the number of sub-pixels—1)*m bits. When a particular area (e.g., the lower m bits) of sub-pixels within a pixel is the same information, repetition is unnecessary, and the same lower m-bit value is thus generated as pseudo control data, included in a control packet, and provided by the timing controller to the data driving unit so that a high quality image can be output without loss of image data, as shown in FIG. 7.

Figure 8:
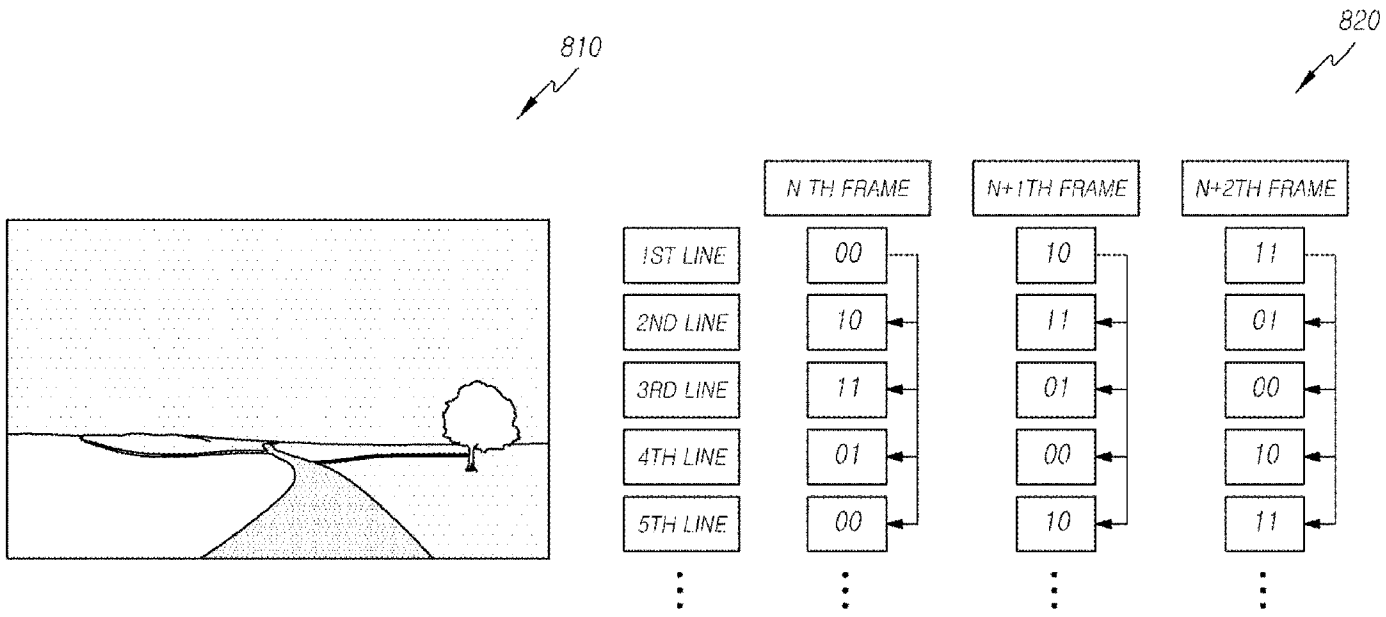
FIG. 8 is a diagram illustrating a configuration of setting pseudo control data for image data according to another embodiment of the present invention.

Next, FIG. 8 is a diagram illustrating a configuration of setting pseudo control data for image data according to another embodiment of the present invention. Like FIG. 7, when the lower two bits of RGB image data is gray having one value, the timing controller can generate pseudo control data to include the same two-bit value, and provide the same to the data driving unit.

Further, when image data expressed by each of sub-pixels varies like FIG. 8, the lower two-bit data value may not be the same. To this end, the present invention can analyze an entire image, and configure particular pseudo control data for each frame and each gate line, based on the selection of the most proper value in image data of RGB sub-pixels for each pixel. As reference numeral 820 indicates in FIG. 8, pseudo control data applied to each frame and each gate line are different. For a pseudo control data value, a representative value of corresponding RGB image data can be selected, a mode and an average value can be selected, or one of a number of values can be applied in rotation.

Further, the timing controller 140 can transmit, to the data driving unit 120, two-bit pseudo control data for each horizontal line (gate line), using an EPI control packet. Further, depending on a change in a pattern value, the value of pseudo control data can be changed based on a weight value, and have a difference according to regular digital and analog values.

Figure 9:
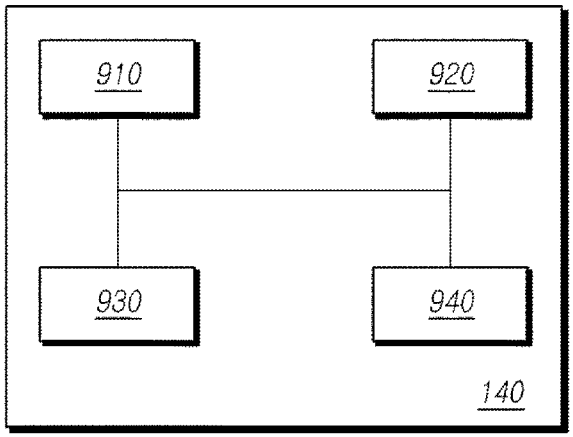
FIG. 9 is a diagram illustrating a configuration of a timing controller according to an embodiment of the present invention.

Next, FIG. 9 is a diagram illustrating a configuration of a timing controller 140 according to an embodiment of the present invention. The above description describes that the data driving unit 120 includes the digital unit 510 and the analog unit 520. A display panel has p*q sub-pixels defined using p numbers of data lines and q numbers of gate lines, and a reception unit 910 (receiver) receives image data for the sub-pixels from a host and stores the same in a memory unit 920.

Here, the image data means (n+m)-bit image data for each sub-pixel. For example, if a sub-pixel indicates one of R, G, and B colors, (n+m)-bits are received for image data of the corresponding sub-pixel from the host. As described hereinbefore, when the number of sub-pixels constituting a pixel is three (RGB), all RGB image data can be included in a packet like reference numeral 310 of FIG. 3, and RGB image data can be divided and included in two packets like reference numeral 320 of FIG. 3.

The above description describes that when image data received from the host is 10 bits for each sub-pixel, n is eight and m is two where m-bit is LSB m bit. In addition, a control unit 930 (controller) generates pseudo control data corresponding to m bit-image data of two or more sub-pixels. As described in FIGS. 7 and 8, when a pixel has three sub-pixels of RGB, pseudo control data can be generated by applying actual data to the pseudo control data corresponding to a least significant two bits of image data (FIG. 7), performing rotation for each frame/gate line, or selecting a representative value using an average value, a mode, etc.

In addition, an output unit 940 provides n bits for each sub-pixel to the digital unit 510 of the data driving unit, described in FIG. 5, and provides m bits, which is pseudo control data, to the analog unit 520 of the data driving unit described in FIG. 5. As the result, the data driving unit can output image data on the display panel, using total 10-bit information provided by the digital unit 510 and the analog unit 520.

Figure 10:
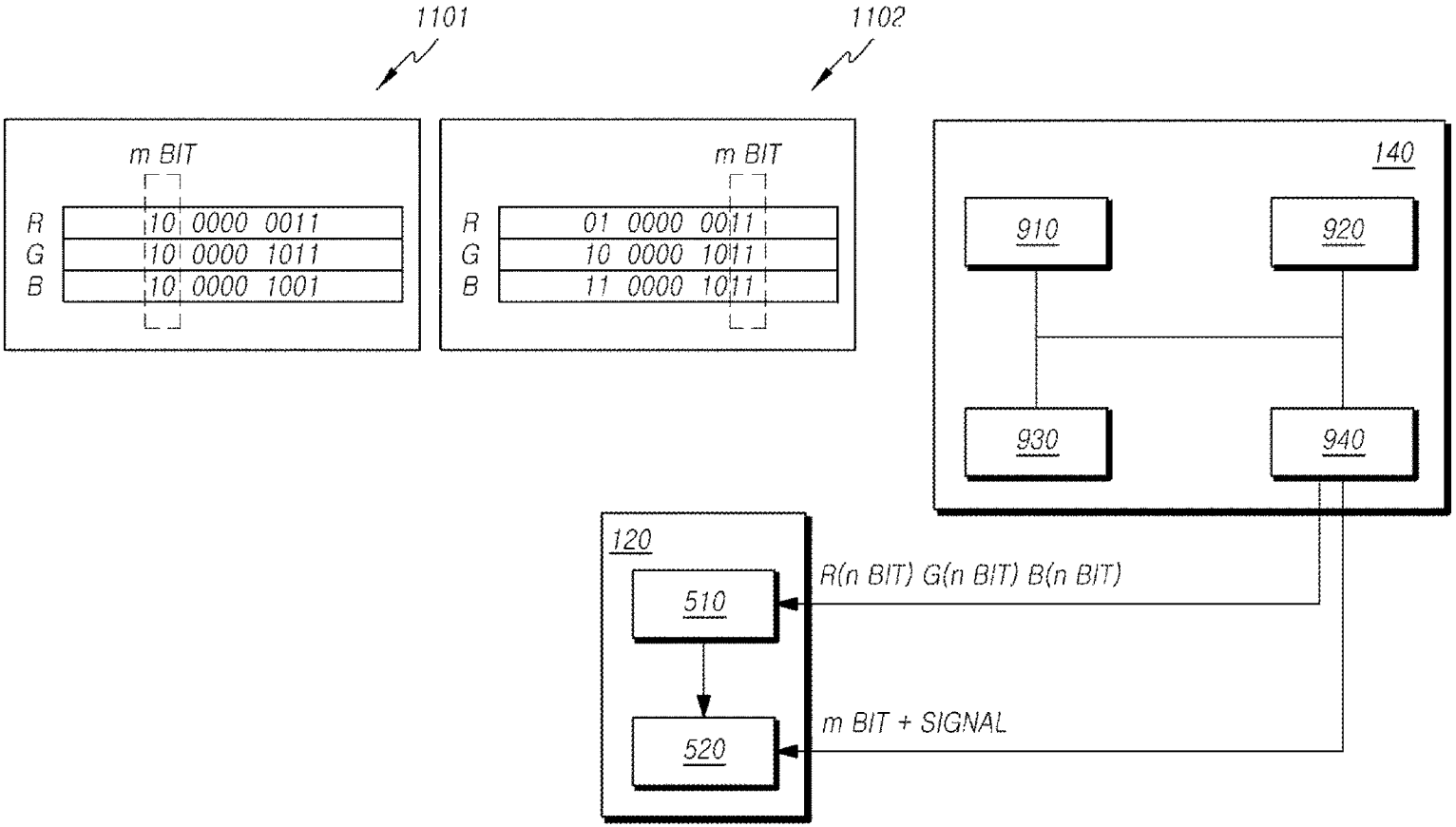
FIG. 10 is a diagram illustrating pseudo control data according to an embodiment of the present invention.

The embodiment of using actual image data for generating, by the control unit 930, pseudo control data has been described in FIG. 7. Additional embodiments are described as in FIG. 10. In particular, FIG. 10 is a diagram illustrating pseudo control data according to an embodiment of the present invention. M bits to be used as pseudo control data is not limited to an LSB, and can be also applied to a most significant bit (MSB).

Further, the timing controller 140 can analyze image data stored in the memory unit 920, and select an MSB (the upper m bits) when a proper part to be used as pseudo control data among RGB image data of a pixel is the MSB. As described in reference numeral 1101 of FIG. 10, the upper two bits, taken as m bits, are used as pseudo control data. As described in reference numeral 1102 of FIG. 10, the lower two bits, taken as m bits, are used as pseudo control data.

In addition, the timing controller 140 can analyze image data of an entire panel or image data of a particular horizontal line and select whether to use the upper bits or the lower bits as pseudo control data. The timing controller 140 can provide a signal bit for notifying the data driving unit of whether to use m bits of the upper bits as pseudo control data or m bits of the lower bits as pseudo control data.

In FIG. 10, the timing controller 140 provides n bits (total 3n bits) and m bits for each of RGB and a signal bit to the data driving unit 120. Image data to be originally transmitted is 30 bits for all RGB, but is 27 bits according to 24 bits+3 bits, so as to reduce the amount of transmitted data by 10% when the embodiment of FIG. 10 is applied. When an MSB or an LSB is pre-fixed, the amount of data transmitted in 26 bits may be further reduced. Further, a representative value is selected between the upper or lower m bits of RGB, and can be selected among a mode value, an average value, a median value, etc., in consideration of a color and order of sub-pixels constituting a pixel.

This relates to image data of one sub-pixel, and the timing controller 140 provides, using the same scheme described in FIG. 10, to the data driving unit 120, image data to be applied to entire data lines controlled by the data driving unit 120, as described hereinbefore.

Thus, when the present invention is applied, a high resolution image can be implemented without separately improving a bandwidth. Some (m bits) of image data including expanded color data is included in a control packet and transmitted as pseudo control data in order to express a high resolution image. That is, some of the data packet can be included in the control packet of an intra interface and transmitted.

Further, the timing controller can transmit, to the data driving unit, the control packet including pseudo control data and the data packet (including n-bit image data for each sub-pixel), and the data driving unit can combine the pseudo control data and the image data of the data packet and output the image data on the display panel. The timing controller can also analyze a pattern using a frame memory for maintaining the quality of image so as to apply actual image data to pseudo control data (FIG. 7), or generate pseudo control data using an interpolated scheme so as to apply the same to m-bit image data for each sub-pixel (FIG. 8).

Figure 11:
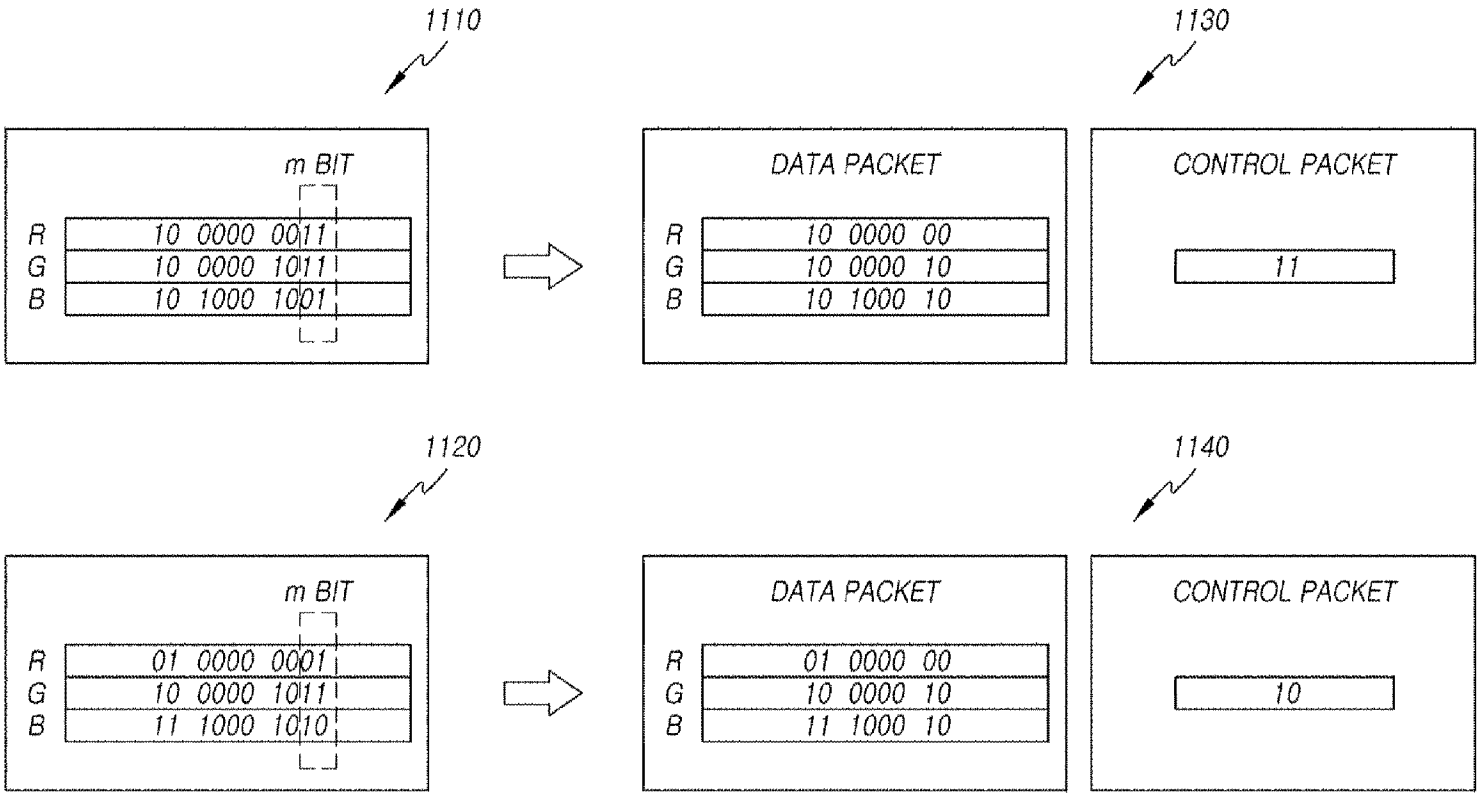
FIG. 11 is a diagram illustrating selecting a representative value of two or more sub-pixels for pseudo control data according to an embodiment of the present invention.

Next, FIG. 11 is a diagram illustrating selecting a representative value of two or more sub-pixels for pseudo control data according to an embodiment of the present invention. Reference numeral 1110 of FIG. 11 describes image data of RGB sub-pixels. In case of reference numeral 1110, "11" which is two bits having a mode value, is selected, as pseudo control data, among the lower two bits of each RGB, in order to generate the lower two bits as the pseudo control data. As the result, like reference numeral 1130, the timing controller includes each of the upper eight bits of RGB in the data packet, and includes "11", which is selected as the mode value in the lower two bits, in the control packet as pseudo control data, so as to provide the same to the data driving unit.

Reference numeral 1120 of FIG. 11 describes image data of RGB sub-pixels. In case of reference numeral 1120, "10", which is two bits having a median value, is selected as pseudo control data among "11" and "10", each of which are the lower two bits of each RGB, in order to generate the lower two bits as the pseudo control data. As the result, like reference numeral 1140, the timing controller includes each of the upper eight bits of RGB in the data packet, and includes "10", which is selected as a mode value in the lower two bits, in the control packet as the pseudo control data, so as to provide the same to the data driving unit.

Because the size of data transmitted in each of reference numerals 1130 and 1140 is 26 bits, which is 14% smaller than 30 bits that is the size of RUB data in reference numerals 1110 and 1120 hereinbefore, a data compression ratio can be increased. In FIG. 11, upon selecting the lower m bits, a mode value or a median value is applied. However, as described in FIG. 8 hereinbefore, upon outputting image data of each gate line/data line of the entire display panel, the least significant m bits of R, G, and B can be displayed in rotation. The least significant m bits may be selected in order to achieve a color balance and a luminance balance for each frame or each line.

Although pieces of information on particular areas (e.g., the lower m bits) of sub-pixels within a pixel are not the same, when pseudo control data is generated using common information or representative information therefrom, the identicality between image data and image data of the host can be increased while the compression ratio in data transmission is increased. In particular, when data is divided using a scheme for including pseudo control data in the control packet, high resolution can be implemented without separately improving a bandwidth. Further, upon processing data by the digital unit of the data driving unit, for a low resolution configuration, a high resolution image can be output by the analog unit through the control packet even without separately changing a circuit in the digital unit.

Figure 12:
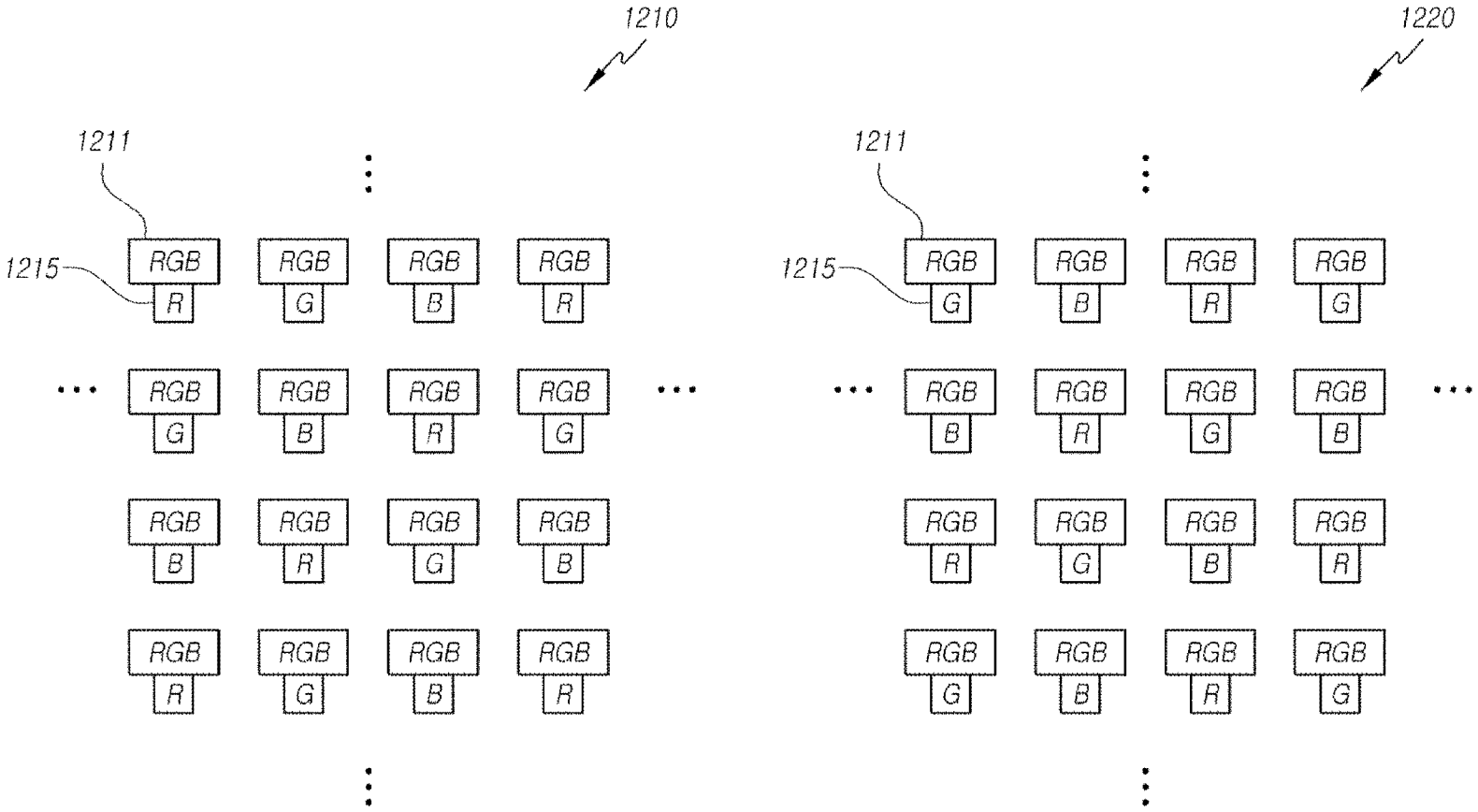
FIG. 12 is a diagram illustrating a configuration of m-bits in which RGB image data to be displayed on a display panel is a particular n-bit and pseudo control data according to an embodiment of the present invention.

Next, FIG. 12 is a diagram illustrating a configuration of m-bit in which RGB image data to be displayed on a display panel is a particular n-bit and pseudo control data according to an embodiment of the present invention. Reference numeral 1211 indicates n bits of each RGB image data, and reference numeral 1215 indicates sub-pixels, which is m bits of a particular sub-pixel, among m bits of RGB image data, which is not included in reference numeral 1211. For example, reference numeral 1211 corresponds to the data packet in reference numeral 1130 of FIG. 11. Reference numeral 1215 indicates to which m bits of sub-pixels the m bits of a particular sub-pixel belong.

In FIG. 12, reference numeral 1210 describes that m bits of R, G, and B are selected by alternating data lines and gate lines in RGB. In addition, reference numeral 1220, which comes next to reference numeral 1210, describes that a representative sub-pixel used as pseudo control data has been changed in a pixel defined in the same gate lines/data lines of a previous frame 1210. That is, a sub-pixel, which has selected the lower m bits of R as pseudo control data in reference numeral 1210, selects the lower m bits of G in reference numeral 1220, which comes next to 1210.

The sub-pixel, which has selected the lower m bits of G as pseudo control data in reference numeral 1210, selects the lower m bits of B in reference numeral 1220, which comes next to 1210. Further, the sub-pixels, which has selected the lower m bits of B as pseudo control data in reference numeral 1210, selects the lower m bits of R in reference numeral 1220, which comes next to 1210.

In order to prevent imbalance of an image from occurring due to selecting the lower m bits of a sub-pixel among sub-pixels constituting a pixel, m bits to be selected as pseudo control data in each pixel can be interpolated for each gate line, each data line, or each frame, so as to maintain the quality of an average image output. In addition, image data of the entire display panel can be analyzed and the order of sub-pixels used in a previous/later gate line/data line or frame can be considered to determine the lower m bits of which sub-pixels is to be selected as pseudo control data, among sub-pixels of a pixel for each gate line/data line or each frame. The selection can be made based on an image required to be output by each pixel on the entire display panel, and through this, efficiency obtained by both outputting a high resolution image and maintaining a bandwidth can be improved.

According to the embodiments of the present invention as described above, a high resolution data transmission is possible while improving the bandwidth between the timing controller and the data driving unit without increasing a transmission overhead. Further, a high resolution image can be implemented without additional bandwidth improvement. In addition, upon processing data by the digital unit of the data driving unit, a high resolution image can be output by the analog unit through a control packet without an additional circuit change by the digital unit even in case of a low resolution configuration.

The present invention encompasses various modifications to each of the examples and embodiments discussed herein. According to the invention, one or more features described above in one embodiment or example can be equally applied to another embodiment or example described above. The features of one or more embodiments or examples described above can be combined into each of the embodiments or examples described above. Any full or partial combination of one or more embodiment or examples of the invention is also part of the invention.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A timing controller comprising:

a memory storing image data with respect to p*q sub-pixels defined using p numbers of data lines and q numbers of gate lines, wherein p is a positive integer of a multiple of three and q is a positive integer;

a receiver receiving, from a host, (n+m)-bit image data with respect to each of two or more of the sub-pixels, wherein n and m are positive integers;

a controller generating pseudo control data corresponding to m-bit image data of the two or more of the sub-pixels; and an output unit outputting n-bit image data with respect to each of the sub-pixels to a digital unit of a data driving unit, and outputting the pseudo control data to an analog unit of the data driving unit, wherein the pseudo control data is included in a control packet and the n-bit image data is included in an RGB data packet.

2. The timing controller of claim 1, wherein, when the m-bit image data of the two or more of the sub-pixels are the same, the controller is further configured to generate the m-bit image data as the pseudo control data.

3. The timing controller of claim 1, wherein, when the m-bit image data of the two or more of the sub-pixels are different, the controller is further configured to select one of a mode value, median value, and average value of the m-bit image data of the two or more of the sub-pixels so as to generate the selected value as the pseudo control data.

4. The timing controller of claim 1, wherein, when the m-bit image data of the two or more of the sub-pixels are different, the controller is further configured to generate m-bit image data of a first sub-pixel as the pseudo control data in an f-th frame, and generate m-bit image data of a second sub-pixel as the pseudo control data in an (f+1)-th frame, f being a positive integer.

5. The timing controller of claim 1, wherein the controller is further configured to generate m-bit image data of a first sub-pixel as the pseudo control data in a g-th gate line, and m-bit image data of a second sub-pixel as the pseudo control data in a (g+1)-th gate line, g being a positive integer.

6. The timing controller of claim 1, wherein the sub-pixels indicate each of red (R), green (G), and blue (B) colors and comprise a pixel, and wherein the controller is further configured to set a representative value among the lower m bits and upper m bits of the R, G, and B sub-pixels as the pseudo control data.

* * * * *